United States Patent [19]

Wakeman

[11] Patent Number: 4,508,091

[45] Date of Patent: Apr. 2, 1985

[54] FUEL METERING APPARATUS WITH MULTI-STAGE FUEL METERING VALVE ASSEMBLY

[75] Inventor: Russell J. Wakeman, Novi, Mich.

[73] Assignee: Colt Industries Operating Corp, New York, N.Y.

[21] Appl. No.: 354,876

[22] Filed: Mar. 4, 1982

Related U.S. Application Data

[62] Division of Ser. No. 88,361, Oct. 26, 1979, Pat. No. 4,342,443.

[51] Int. Cl.[3] ..... F02M 51/06; B05B 1/30

[52] U.S. Cl. ..... 123/586; 123/458; 123/472; 123/530; 239/585; 251/285; 251/137

[58] Field of Search ..... 261/78 R, 50 A; 123/586, 587, 437, 438, 440, 472, 530, 531, 458, 470, 590, 336; 251/137, 68, 141, 121, 284, 285; 239/585, 533.2–533.12

[56] References Cited

U.S. PATENT DOCUMENTS

| | | | |
|---|---|---|---|
| 1,822,668 | 9/1931 | Protzeller | 251/285 |
| 2,637,407 | 5/1953 | Burk | 251/68 |
| 2,769,943 | 11/1956 | Mathews | 251/137 |
| 3,079,947 | 3/1963 | Hunt | 251/137 |
| 3,942,485 | 3/1976 | Suda | 251/137 |
| 4,007,880 | 2/1977 | Haius | 239/585 |
| 4,335,693 | 6/1982 | Cowles | 127/585 |
| 4,342,443 | 8/1982 | Wakeman | 251/137 |

*Primary Examiner*—Charles J. Myhre
*Assistant Examiner*—Carl Stuart Miller
*Attorney, Agent, or Firm*—Walter Potoroka, Sr.

[57] ABSTRACT

A fuel metering apparatus is shown as having a throttle body with induction passage means therethrough and a throttle valve for controlling flow through the induction passage means; fuel under superatmospheric pressure is metered through a multi-stage fuel metering valve assembly and such metered fuel is supplied as to the induction passage means; the multi-stage metering valve assembly is shown as having a valve member with a step-like surface reciprocatingly cooperating with a metering orifice of fixed effective flow area so that during a first range of metered fuel flow a first portion of the step-like surface is effective for cooperating with the metering orifice in determining the rate of metered fuel flow while during a second range of metered fuel flow a second portion of the step-like surface is effective for cooperating with the metering orifice in determining the rate of metered fuel flow.

5 Claims, 3 Drawing Figures

FUEL METERING APPARATUS WITH MULTI-STAGE FUEL METERING VALVE ASSEMBLY

This is a division of application Ser. No. 88,361, filed Oct. 26, 1979, now U.S. Pat. No. 4,342,443.

FIELD OF INVENTION

This invention relates generally to fuel metering systems and more particularly to fuel metering valve assembly for metering fuel flow as to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

The prior art is trying to meet the standards for $NO_x$ emissions has employed a system of exhaust gas recirculation whereby at least a portion of the exhaust gas is reintroduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting fuel through individual injector nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems (especially those employing injection nozzles with moving pintles or the like) which are very accurate at one end of the required range of metered fuel flows, are relatively inaccurate at the opposite end of that same range of metered fuel flows. Also, when such prior art injection systems are made to be accurate in the mid-portion of the required range of metered fuel flows are usually relatively inaccurate at both ends of that same range. The use of feed-back means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to provide a fuel metering valving assembly which is electrically operated in response to electronically sensed signals. In such an electronic fuel metering valve assembly, the valve member is generally reciprocatingly moved toward and away from a cooperating metering orifice thereby correspondingly closing and opening such orifice to the flow of fuel therethrough. The percentage of time, within any selected span of time, in which the valve member is away from the orifice determines, in effect, the rate of flow therethrough. That is, the greater the percentage of time, the greater is the rate of metered fuel flow.

Such electronic fuel metering valve assemblies have been employed to meter fuel to the associated engine over a great range of engine speed and load conditions. Some engines, because of their design and or engine accessories, require a dramatically high rate of metered fuel flow as, for example, during maximum acceleration (maximum load) conditions. In such situations, of course, the metering orifice of the electronic fuel metering valve assembly has to be of a size sufficient to permit the maximum fuel flow required by the engine. However, as a consequence of this, it has been discovered that although the metering characteristics of the electronic fuel metering valve assembly are accurate during most of the entire range of required rates of metered fuel flow, it becomes somewhat inaccurate at the very low range of rate of metered fuel flow as where the relatively very large area metering orifice is being opened for a very short time by the cooperating valve member.

Accordingly, the invention as disclosed, described and claimed is directed, primarily, to the solution of such and other related and attendant problems of the prior art.

SUMMARY OF THE INVENTION

According to the invention, a metering valving assembly for metering rates of liquid flow has a metering orifice and a cooperating metering valve member, a first solenoid winding is situated as to upon energization and de-energization cause the metering valve member to move away from and toward the metering orifice with the degree of movement away from the metering orifice being determined by a stop member against which the metering valve member abuts, and a second solenoid winding for positioning the stop member as to thereby selectively determine the distance which the metering valve member will travel from the metering orifice, and a contoured extension of the metering valve member extending into the metering orifice, the contoured extension occupying more space within the metering orifice the lesser the distance that the metering valve member travels away from the metering orifice.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted.

DETAILED DESCRIPTION OF THE PREFERRED EMBODIMENT

Figure 1:
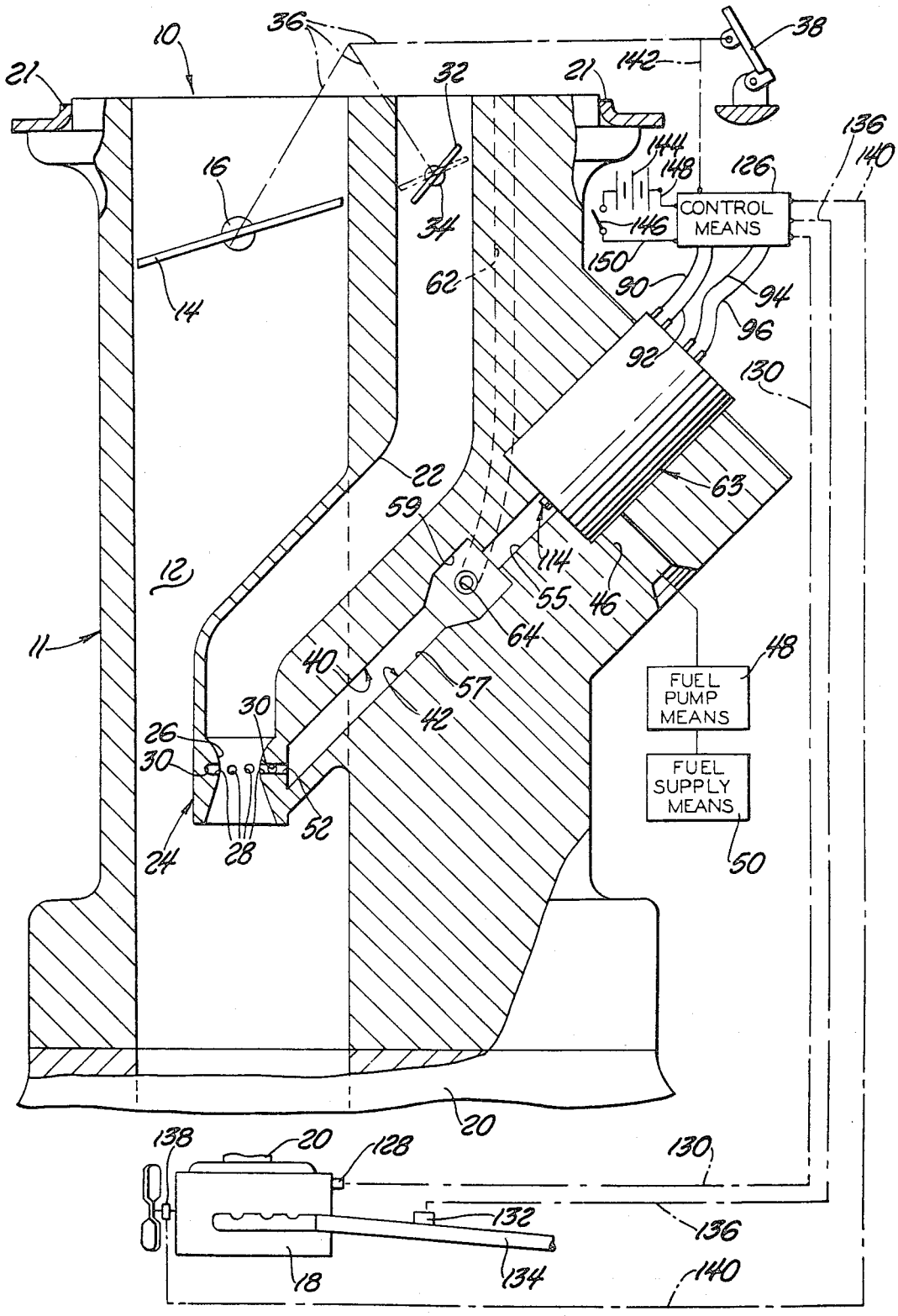
FIG. 1 illustrates in cross-section a fuel injection apparatus and system employing a multi-stage fuel metering assembly employing teachings of the invention.

Referring now in greater detail to the drawings, FIG. 1 illustrates fuel injection apparatus and system 10 comprised as of induction body or housing means 11 having main induction passage means 12 wherein a throttle valve 14 is situated and carried as by a rotatable throttle shaft 16 for rotation herewith thereby variably restricting the flow of air through the induction passage means 12 and into the engine 18 as via associated engine intake manifold means 20. If desired, suitable air cleaner means may be provided as to generally emcompass the inlet of induction passage means 12 as generally fragmentarily depicted at 21. Second or separate induction passage means 22 is also provided in housing means 11 as for the passage therethrough of idle engine operation air flow. As depicted, the downstream portion of induction passage means 22 communicates as with fuel discharge nozzle means 24 which preferably comprises a venturi-like fuel atomizing portion 26 provided with fuel discharge port means comprised as of a plurality of discharge ports 28 communicating with an annulus 30. An idle air flow valve 32, situated in auxiliary induction passage 22, may be carried by related rotatable shaft means 34 for pivotal rotation therewith. The throttling valve means 14 and 32 may be suitably operatively interconnected as through related linkage and motion transmitting means 36 to the operator positioned throttle control means which may be the operator footoperated throttle pedal or lever 38 as usually provided in automotive vehicles.

Fuel supply conduit or passage means 40 may comprise, for example, a first metered fuel passage portion 42 communicating with a second unmetered fuel passage portion 46 leading as to related fuel pumping means 48 which receives its fuel as from associated fuel supply or reservoir means 50. Conduit or passage portion 42 is placed in communication with the discharge orifice means 28 as by suitable conduit means 52 effectively communicating between passage 42 and annulus 30. An electronic fuel metering valve assembly 63 receives the unmetered fuel from conduit means 46 and, upon metering such, discharges metered fuel as into a first conduit segment 55. Further, passage means 40, as at a point downstream of conduit segment 55, is placed in communication with a source of ambient atmosphere as by conduit means 62 comprising calibrated restriction passage means 64.

Figure 2:
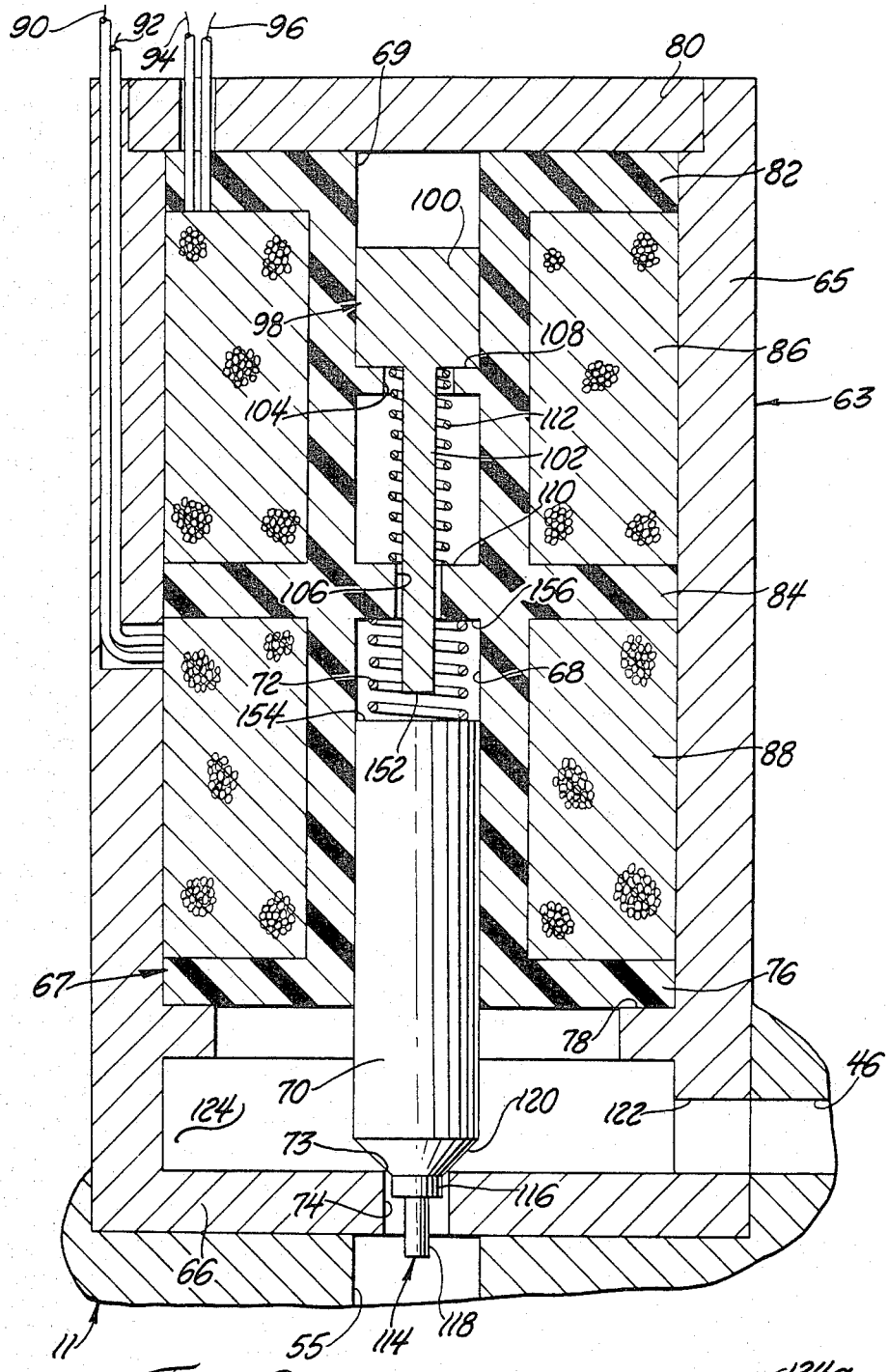
FIG. 2 is an enlarged generally axially extending cross-sectional view of the multi-stage fuel metering assembly of FIG. 1.

Referring in greater detail to FIG. 2, the assembly 63 is depicted as comprising a body or housing 65, generally closed as at one end 66, closely receiving therein a double spool-like bobbin 67 having inner passages 68 and 69 with passage 68 slidably receiving therein a valve member 70 and spring means 72 yieldingly urging valve member 70 downwardly (as viewed in FIG. 2) and into seated engagement with a valve orifice or valve seating surface means 73 generally about the metering orifice 74 formed as in the end wall 66 of housing 65.

The lower or forward most end of bobbin 67 may be suitably seated as by its generally annular radiating wall 76 abuting as against an inner flange or stop portion 78 while the opposite end may be suitably retained as by a cover member 80 operatively engaging the other annular radiating wall 82. The bobbin 67 is preferably provided with an intermediately situated radiating wall portion 84 serving to generally divide the spool 67 into two annular-like chambers respectively receiving field coils or windings 86 and 88 with coil 86 being electrically connected to related control means as by electrical leads or conductor means 90 and 92 while coil 88 is similarly electrically connected to related control means as by electrical leads or conductor means 94 and 96.

Passage 69 slidably receives a variably positionable stop member 98 which, as illustrated, is comprised of a body 100 axially slidable within passage 69 and an extension portion 102 which extends, as through apertures 104 and 106 in walls 108 and 110, respectively, as to be in preselected spaced relationship to the end of valve member 70 when such valve member 70 is in a position closing metering orifice 74. A spring 112, seated as against wall 110, normally resiliently urges stop means 98 (upwardly as viewed in FIG. 2) in a direction away from valve member 70.

Figure 3:
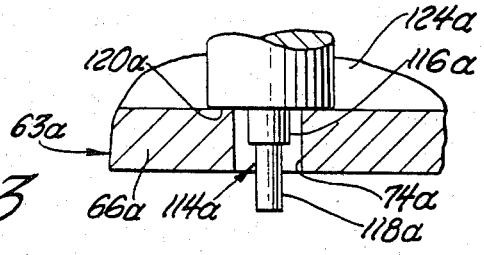
FIG. 3 is a view similar to a fragmentary portion of FIG. 2 illustrating a modified form of one of the elements of FIG. 2.

As best seen in FIG. 2, the valving end of valve member 70 is provided with extension means 114 which, in the preferred embodiment, comprises a first axially extending extension portion 116 of a relatively large diameter and a second axially extending extension portion 118 of a relatively small diameter. As should be apparent, with valve member 70 in a position wherein extension portion 116 is at least partly within orifice means 74, the maximum effective flow area through such orifice means 74 is determined by the area of the space or clearance (transversely) between extension 118 and the juxtaposed inner surface of orifice means 74. In the embodiment of FIG. 2, the valving surface 120 of valve member 70 is depicted as being of contoured or conical configuration. However, it should be apparent that such a surface may be of any desired configuration as, for example, flat as depicted in FIG. 3 at 120*a*. In FIG. 3 only so much of the structure of FIG. 2 is shown as to illustrate the modified form of valve member 70 of FIG. 2; all elements shown in FIG. 3 which are like or similar to those of FIG. 2 are identified with like reference numbers provided with a suffix "a".

With reference to FIG. 2, fuel from unmetered fuel supply conduit 46 enters, as through passage means 122, chamber 124 from where it is metered and discharged as into passage or conduit means 55. In the embodiment of FIG. 3, the closing of orifice means 74*a* would, of course, occur as between the flat valving surface 120*a* and a juxtaposed seating or sealing surface, as possibly carried by wall 66*a*, generally circumscribing metering orifice means 74*a*.

Referring to FIGS. 1 and 2, the related control means 126 may comprise, for example, suitable electronic logic type control and power output means effective to receive one or more parameter type input signals and in response thereto produce related outputs. For example, engine temperature responsive transducer means 128 may provide a signal via transmission means 130 to control means 126 indicative of the engine temperature; sensor means 132 may sense the relative oxygen content of the engine exhaust gases (as within engine exhaust conduit means 134) and provide a signal indicative thereof via transmission means 136 to control means 126; engine speed responsive transducer means 138 may provide a signal indicative of engine speed via transmission means 140 to control means 126 while engine load, as indicated for example by throttle valve 14 position, may provide a signal as via transmission means 142 to control means 126. A source of electrical potential 144 along with related switch means 146 may be electrically connected as by conductor means 148 and 150 to control means 126.

In the embodiment depicted in FIG. 1, conduit means 42 may comprise passage means 55 in series with a downstream situated conduit section 57 which, in turn, preferably comprises an enlarged chamber-like passage portion 59.

The bleed air passage means 62, communicating as with the ambient, comprises calibrated restriction means 64 and, in the apparatus depicted, such bleed air as is delivered into the metered fuel conduit means 42 is introduced as to have its general path flow generally transverse to the general path of flow of the metered fuel.

OPERATION OF INVENTION

Generally, in the embodiment disclosed, fuel under regulated, substantially constant, pressure is supplied as by fuel pump means 48 to conduit 46 and chamber 124 from where such fuel is metered by the metering function generally cooperatively defined by the valving surface 73, movable valve surface 120 and calibrated passage or metering orifice means 74 from where such metered fuel flows into metered fuel conduit means 42, through inlet passage 52 into annulus 30 and ultimately through discharge port means 28 and to the engine 18. The rate of metered fuel flow, in the embodiment disclosed, will be dependent upon the relative percentage of time, during an arbitrary cycle time or elapsed time, that the valve surface 120 is relatively close to or seated against valve orifice seat 73 as compared to the percentage of time that the valve surface 120 is relatively far away from the cooperating valve orifice seat 73. This, in turn, is dependent on the output to coil 88 from control means 126 which, in turn, is dependent on the various parameter signals received by the control means 126. For example, if the oxygen sensor and transducer means 132 senses the need of a further fuel enrichment in the motive fluid being supplied to the engine and transmits a signal reflective thereof to the control means 126, the control means 126, in turn, will reguire that the metering valve 70 be opened a greater pecentage of time as to provide the necessary increased rate of metered fuel flow. The metering valve assembly 63 is, what may be referred to as, of the duty-cycle type; that is winding or solenoid 88 is intermittently energized thereby causing, during such energization, valve member 70 (which is the armature) to move in a direction away from valve seating surface 73 to a position as against end 152 of stop means 98. As should be apparent, with such a duty-cycle type fuel metering solenoid assembly, the "effective flow area" of the metering orifice means can be variably and controllably determined by controlling the frequency and/or duration of the energization of coil means 88. Generally, it will be understood that given any selected parameters and/or indicia of engine operation and/or ambient conditions, the control means 126 will respond to the signals generated thereby and respond as by providing appropriate energization and de-energization of coil means 88 (causing corresponding movement of valve member 70)

thereby achieving the then required metered rate of fuel flow to the engine.

Generally, stop means 98 is axially positioned in response to the energization of field coil means 86. That is, when control means 126 indicates that the fuel metering is to be accomplished in the relatively low range of rate of metered fuel flow, coil 86 is energized causing the stop means 98 (which is in effect an armature) to move downwardly against the resilient resistance of spring 112 to the position depicted in FIG. 2 as against the wall 108 thereby extending the extension portion 102 as to bring end surface 152 relatively closer to the upper end 154 of valve member 70. Consequently, upon energization of coil means 88 the upward (as viewed in FIG. 2) travel of valve member 70 is limited as to not result in the entire withdrawal of the relatively large valve extension portion 116 from cooperating metering orifice means 74. Further, when the control means 126 determines that the fuel metering is to be in the relatively high range of rates of metered fuel flow, control means 126 does not energize coil 86 thereby permitting spring 112 to move stop means 98 upwardly (as viewed in FIG. 2) causing end 152 of extension 102 to move away from end 154 of valve member 70. In so doing, the stop means 98 may assume a position whereat body 100 thereof is against cover member 80. At such time, depending upon the relative dimensions of the various elements, end surface 152 of extension 102 may still extend some distance into passage 68 or it may be withdrawn into clearance passageway 106 thereby permitting the lower surface 156 of wall 110 and spring 72 to collectively function as stop means for the upward travel of valve member 70 upon energization of coil means 88 by control means 126. In any event, when coil 86 is not energized and coil 88 is energized, the maximum upward travel of valve member 70 is such as to cause total withdrawal of valve extension 116 from metering orifice 74 and yet prevent the total withdrawal of valve extension portion 118 from metering orifice 74 thereby effectively increasing the available metering area of orifice means 74. During each of such conditions of either high or low rates of metered fuel flow, the actual metering is accomplished by the rapid reciprocating motion of the metering valve 70 away from and towards the coacting orifice means 74 and the actual liquid metering, of course, is a function of the pressure differential across the effective area of the metering orifice 74 and the effective area itself.

Generally, it is contemplated that the positioning or energization of the stop means 98 may be accomplished in, for example, either of two ways. That is, when operating in the range of low rates of metered fuel flow, the control means 126 may maintain solenoid coil 86 energized thereby continuously maintaining end 152 in its depicted maximum extended condition and, of course, when operating in the range of relatively high rates of metered fuel flow, the control means 126 would maintain solenoid coil 86 in a de-energized state thereby, through spring 112, maintaining end surface 152 in its uppermost or withdrawn condition.

The other manner of operation, which is preferred, is to have the stop coil means 86 intermittently (pulsed) energized in much the same manner as is coil 88. That is, when operating in the range of relatively low rates of metered fuel flow, the stop means coil 86 would be cyclically intermittently be (pulsed) energized by control means 126 with such cyclic energization corresponding generally to the cyclic energization by control means 126 of metering valve coil 88. In the preferred manner of thusly pulsing the stop means coil 86, the control means 126 would energize the coil 86 slightly in advance (in terms of time) of when the control means 126 would energize the metering valve coil 88. This would then provide for sufficient time for the stop means 98 to travel to the position depicted in FIG. 2 and provide the stop or abutment function for the metering valve 70 as it moves up due to the coil 88 being pulsed. Both of the pulses from the control means 126 to the coils 86 and 88 may, of course, be terminated at the same time. By thusly intermittently pulsing the coil 86 instead of applying a continuous current to the coil 86, the useful life thereof is extended and some energy savings are realized.

It should, of course, now be apparent that the invention may be practiced in other forms. For example, it is possible to practice the invention employing but a single valve extension as, for example, extension 116 of a suitable axial length and to dispense with the second extension as, for example, extension 118. If this were to be done then, of course, the range of high rates of metered fuel flow would occur when such single extension (as 116) was effectively withdrawn from the cooperating metering orifice means 74.

Aside from the benefits and advantages already apparent, the invention has the further benefit of being able to in effect standardize many of the components and yet provide for accurate metering even as between different engines which may have vastly different ranges of required rates of metered fuel flow. For example, the metering assembly 63, generally, can be made as a standard item with a standard size of metering orifice 74. The valve extension 116 or extensions 116 and 118 could then be made as separate pieces to valve member 70 and in varying sizes as to thereby enable the selection of the appropriate size of valve extension or valve extensions to coact with the metering orifice 74 in order to provide the desired resulting maximum effective flow areas for the respective ranges of metered fuel flows.

Although only a preferred embodiment and selected modifications of the invention have been disclosed and described, it is apparent that other embodiments and modifications of the invention are possible within the scope of the appended claims.

What is claimed is:

1. Fuel metering apparatus for supplying metered rates of fuel flow to a combustion engine, comprising body means, induction passage means formed through said body means for supplying motive fluid to said engine, said induction passage means comprising primary induction passage means and main induction passage means, said main induction passage means comprising first inlet means for permitting the inlet of air and first outlet means for discharging motive fluid to said engine, main throttle valve means for variably controlling the rate of flow of air into said first inlet means and through said main induction passage means, said primary induction passage means comprising second inlet means for permitting the inlet of air and second outlet means for discharging motive fluid to said engine, primary throttle valve means for variably controlling the flow of air through said primary induction passage means, said second outlet means comprising sonic venturi discharge nozzle means situated generally in said main induction passage means downstream of said main throttle valve means, a metering valving assembly for metering liquid fuel in response to engine demands and indicia of engine operation, and metered fuel conduit means communicating between said metering valving assembly and said sonic venturi discharge nozzle means, said metering valving assembly comprising metering orifice means, a cooperating metering valve member, first solenoid coil means effective upon being energized and de-energized to cause said metering valve member to move away from and toward said metering orifice means, movable abutment means, and second solenoid coil means, said second solenoid coil means being effective upon being energized to move said abutment means to a selected position to limit the movement of said metering valve member away from said metering orifice means, and a contoured extension of said metering valve member extending into said metering orifice means as to define an effective metering area therebetween, said contoured extension occupying more space within said metering orifice means the lesser the distance said metering valve member travels away from said metering orifice means.

2. Fuel metering apparatus according to claim 1 and further comprising air bleed means communicating between a source of air and said metered fuel conduit means for bleeding air into such liquid fuel as is metered by said metering valving assembly as to thereby create an emulsion of such bleed air and said metered liquid fuel for delivery to said sonic venturi discharge nozzle means.

3. Fuel metering apparatus according to claim 1 wherein said second solenoid coil means when energized is energized in advance of the energization of said first solenoid coil means.

4. Fuel metering apparatus according to claim 1 wherein said metering valving assembly further comprises housing means, bobbin means carried by said housing means, first and second axially extending passage means in said bobbin means, wherein said first solenoid coil means is carried by said bobbin means as to be disposed in relatively close proximity to said first passage means, wherein said second solenoid coil means is carried by said bobbin means as to be disposed in relatively close proximity to said second passage means, wherein said metering valve member is slidably received by said second passage means, and wherein said movable abutment means is slidably received by said first passage means.

5. Fuel metering apparatus according to claim 4 and further comprising first spring means effective for resiliently urging said metering valve member in a first direction toward said metering orifice means, and second spring means effective for resiliently urging said movable abutment means in a direction generally away from said metering valve member, said first spring means comprising compression spring means situated in said second passage means and operatively connected to said valving member.

* * * * *